US007980864B2

(12) United States Patent
Huang

(10) Patent No.: US 7,980,864 B2
(45) Date of Patent: Jul. 19, 2011

(54) CONNECTOR FOR FLEXIBLE PRINTED CIRCUIT BOARD

(75) Inventor: Sheng-Yuan Huang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 131 days.

(21) Appl. No.: 12/553,393

(22) Filed: Sep. 3, 2009

(65) Prior Publication Data

US 2011/0053390 A1 Mar. 3, 2011

(51) Int. Cl.
*H01R 12/00* (2006.01)

(52) U.S. Cl. ..... 439/67; 439/260

(58) Field of Classification Search ..... 439/67, 439/260, 263, 267, 495
See application file for complete search history.

(56) References Cited

U.S. PATENT DOCUMENTS 5,240,430 A * 8/1993 Soes ..... 439/260
5,542,855 A * 8/1996 Asai ..... 439/260
5,902,142 A * 5/1999 Kondo et al. ..... 439/267
6,129,573 A * 10/2000 Juntwait et al. ..... 439/329
7,625,232 B2 * 12/2009 Lin et al. ..... 439/495

* cited by examiner

*Primary Examiner* — T C Patel
*Assistant Examiner* — Travis Chambers
(74) *Attorney, Agent, or Firm* — Cheng-Ju Chiang

(57) ABSTRACT

A connector adapted for receiving a longitudinally inserted flexible printed circuit board therein includes an insulating housing having a base board, a plurality of electric terminals disposed in the insulating housing and a pressing cover vertically movably mounted onto the insulating housing. Two opposite ends of the base board protrude upward to form a pair of sidewalls. Each of the electric terminals has an elastic arm. The flexible printed circuit board is inserted between the base board and the elastic arms. A portion of a base portion of the pressing cover extends forward to form a pressing portion transversely spanned over the elastic arms of the electric terminals for pressing the elastic arms downward against the flexible printed circuit board when the pressing cover is pressed downward to be closed so as to make the flexible printed circuit board tightly clipped between the elastic arms and the base board.

10 Claims, 6 Drawing Sheets

CONNECTOR FOR FLEXIBLE PRINTED CIRCUIT BOARD

BACKGROUND OF THE INVENTION

1. Field of the Invention

The present invention generally relates to an electrical connector, and more particularly to a connector for a flexible printed circuit (FPC hereinafter for simplification) board.

2. The Related Art

A conventional FPC connector adapted for receiving an FPC board therein includes an insulating housing with the FPC board therein, an actuator pivoted to the insulating housing and a plurality of electric terminals disposed in the insulating housing for electrically contacting the FPC board. The actuator is pivoted to the insulating housing to make an angle with the FPC board. The angle is gradually reduced as the actuator gets closer to the FPC board so that one end of the actuator presses the FPC board before the actuator is fully closed. Therefore, the FPC board may move due to the actuator moves so that the electrical connection between the FPC board and the electric terminals is unstable.

SUMMARY OF THE INVENTION

An object of the present invention is to provide a connector adapted for receiving a longitudinally inserted flexible printed circuit board therein. The connector includes an insulating housing having a base board disposed levelly, a plurality of electric terminals disposed in the insulating housing in a transverse row and a pressing cover vertically movably mounted onto the insulating housing. Two opposite ends of the base board protrude upward to form a pair of sidewalls extending longitudinally with a receiving recess formed therebetween for receiving the flexible printed circuit board. Each of the electric terminals has an elastic arm stretched into the receiving recess and suspended over the base board. The flexible printed circuit board is longitudinally inserted between the base board and the elastic arms for electrically connecting the electric terminals. The pressing cover has a base portion extending transversely to be spanned onto the two sidewalls. A portion of the base portion extends forward to form a pressing portion transversely spanned over the elastic arms of the electric terminals for pressing the elastic arms downward against the flexible printed circuit board when the pressing cover is pressed downward to be closed so as to make the flexible printed circuit board tightly clipped between the elastic arms and the base board.

As described above, the pressing cover of the flexible printed circuit board connector is vertically mounted onto the insulating housing so that the pressing cover can contact the flexible printed circuit board at the same time for avoiding the flexible printed circuit board moving along the insertion and withdrawal direction thereof during the pressing cover is closed and further ensuring a stable electrical connection between the electric terminals and the flexible printed circuit board.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
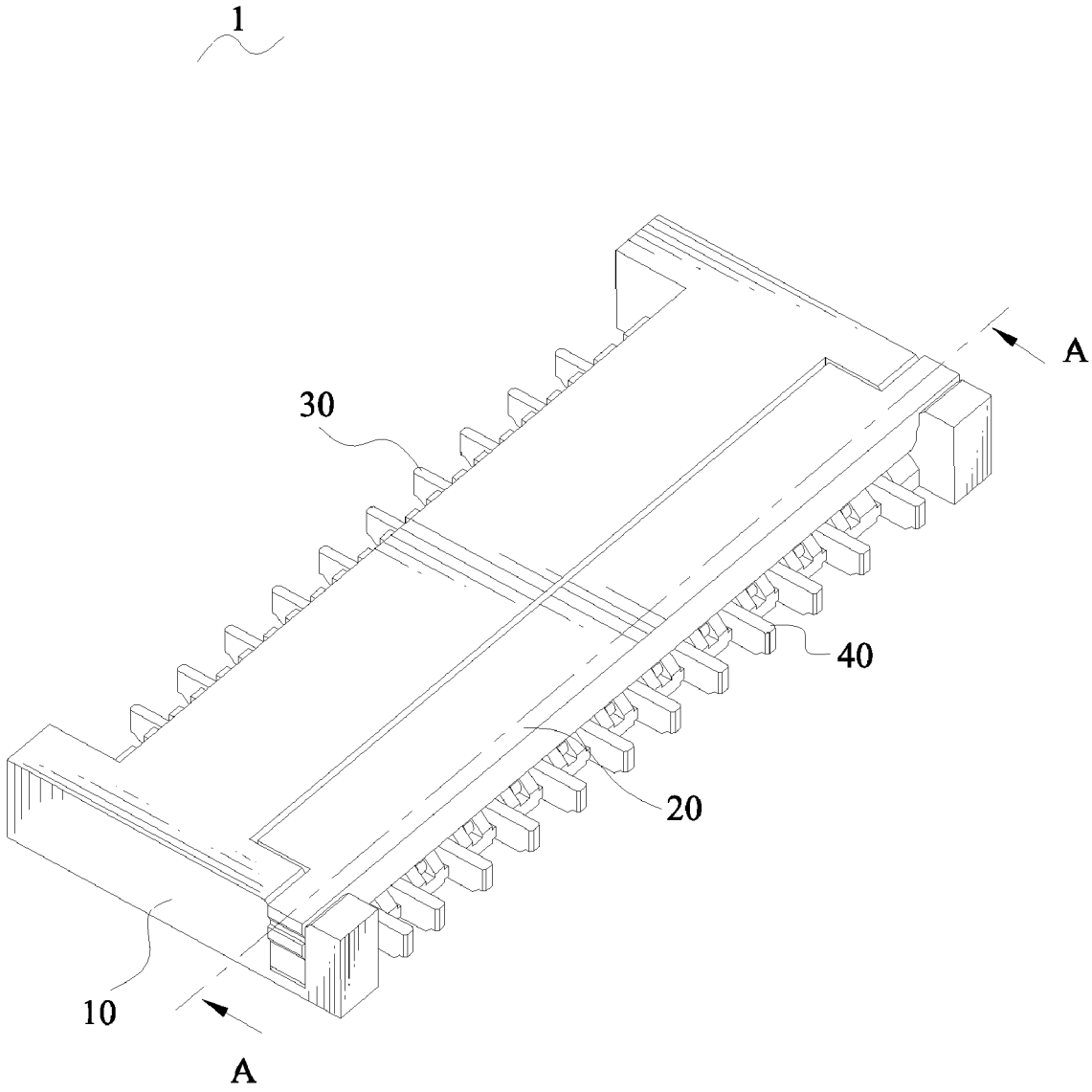
FIG. 1 is a perspective view of an FPC connector in accordance with the present invention.
Figure 2:
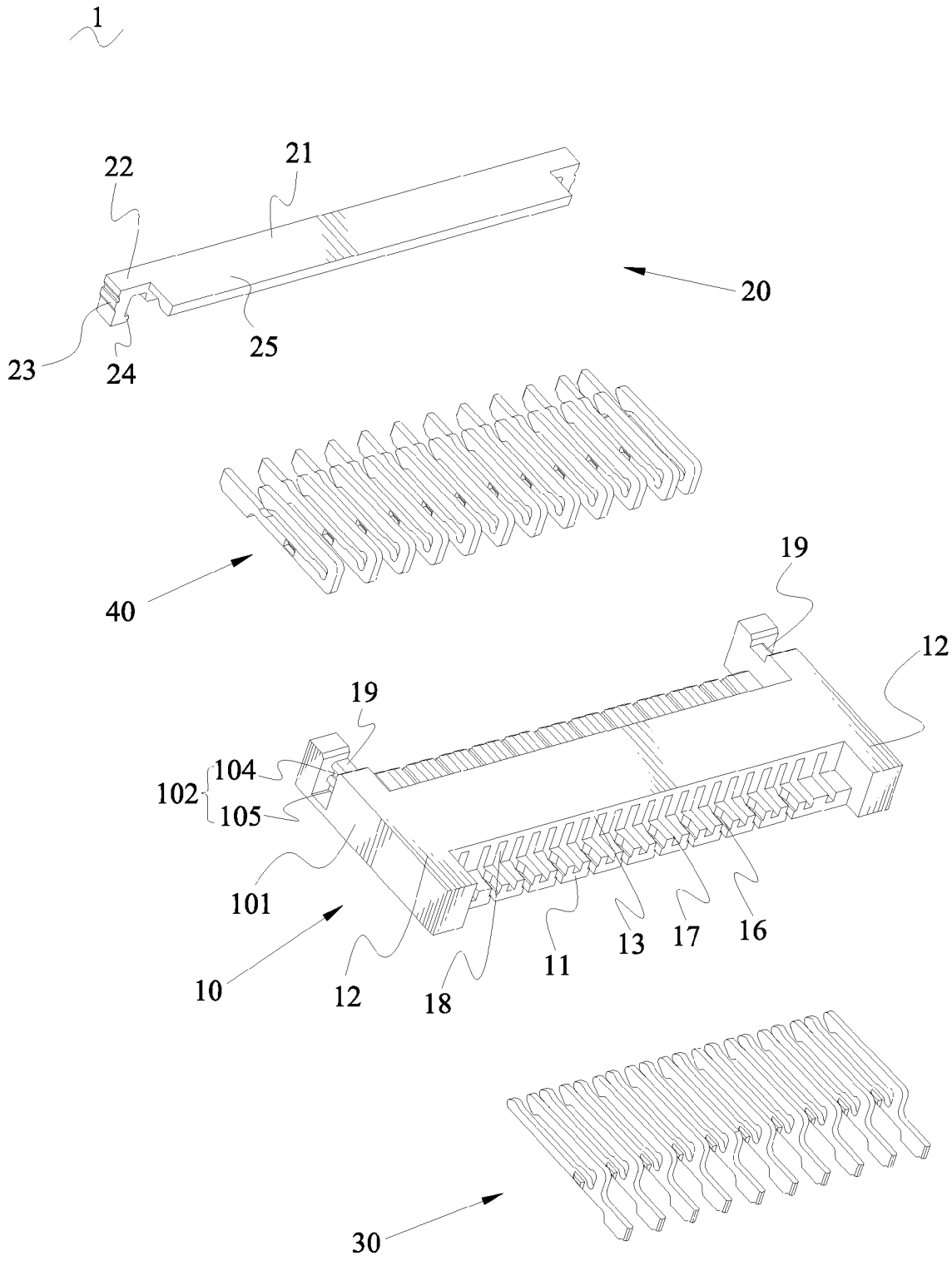
FIG. 2 is an exploded view of the FPC connector of FIG. 1.

Referring to FIG. 1 and FIG. 2, an FPC connector 1 in accordance with the present invention includes an insulating housing 10, a pressing cover 20 mounted to the insulating housing 10, a plurality of first electric terminals 30 and a plurality of second electric terminals 40 disposed in the insulating housing 10 respectively.

Figure 3:
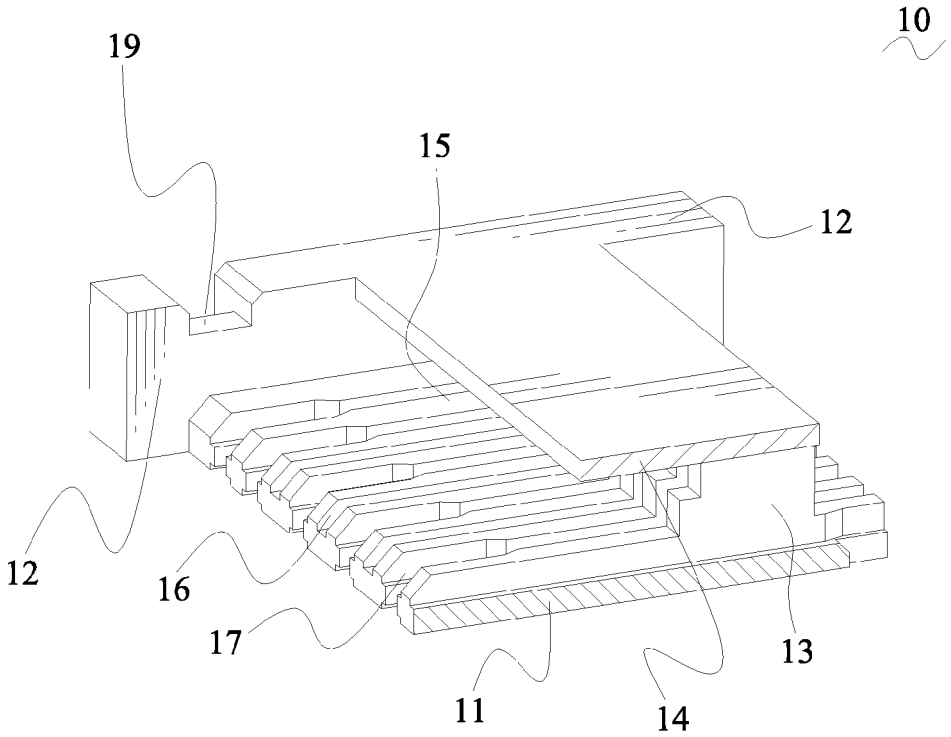
FIG. 3 is a sectional view of an insulating housing of the FPC connector of FIG. 1.
Figure 8:
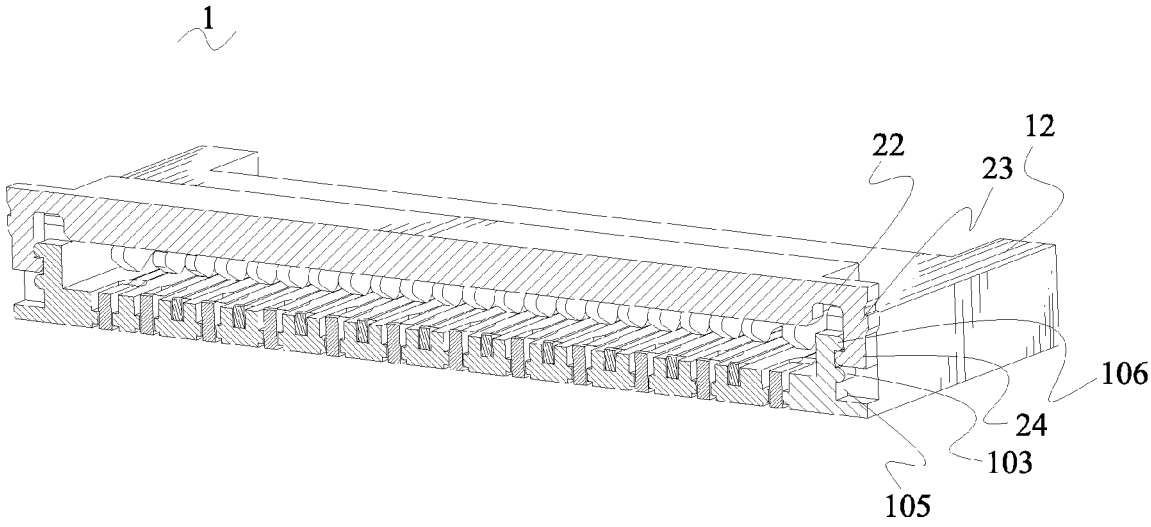
FIG. 8 is a sectional view of the FPC connector of FIG. 1 along line A-A.
Figure 9:
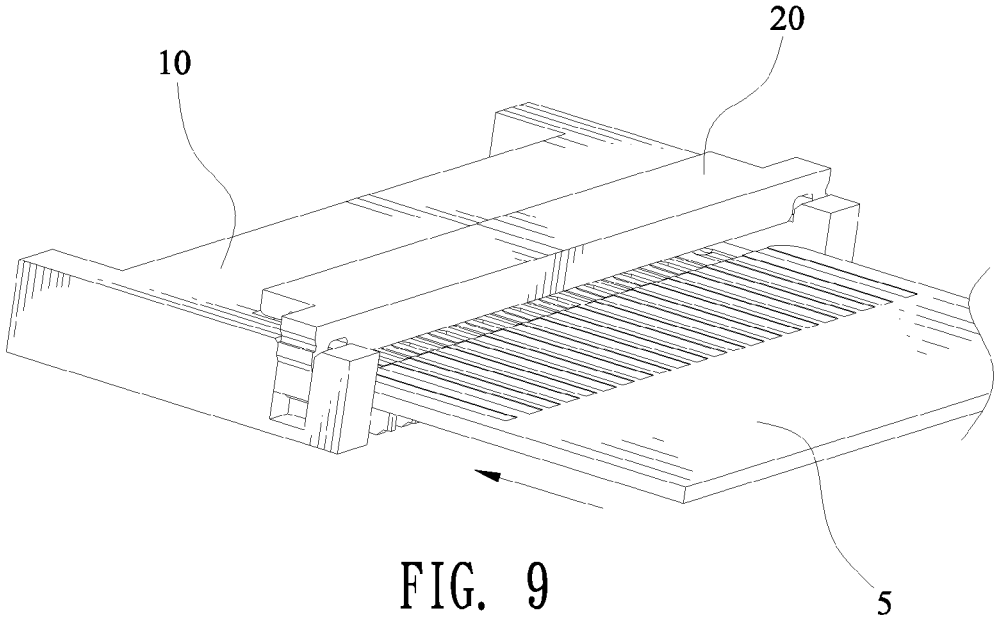
FIG. 9 is a perspective view of the FPC connector of FIG. 1, in which an FPC board is inserted.
Figure 10:
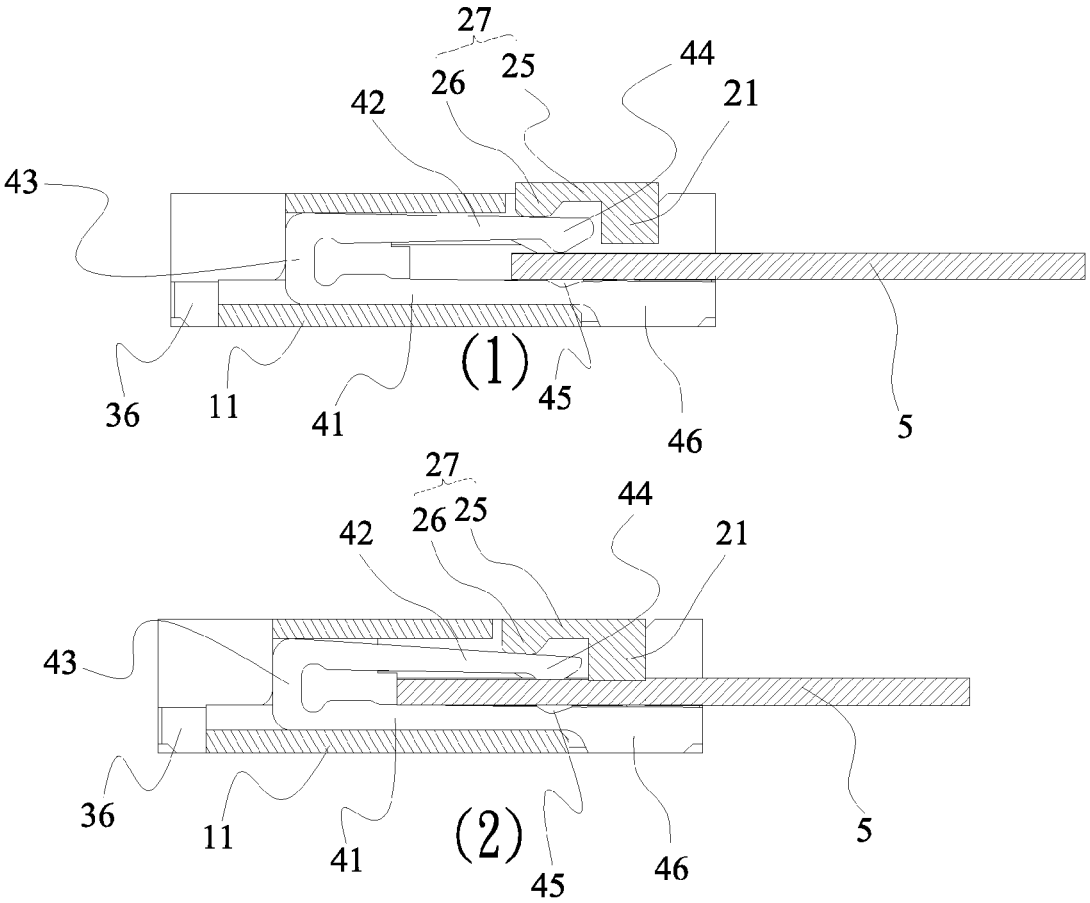
FIG. 10 is a cross-sectional view of the FPC connector with the FPC board therein of FIG. 10, showing two statuses of the pressing cover being opened with the FPC board partially inserted into the FPC connector and the pressing cover being closed with the FPC board fully inserted into the FPC connector.

Referring to FIG. 2, FIG. 3 and FIG. 8, the insulating housing 10 has a rectangular flat base board 11. Two opposite ends of the base board 11 protrude upward to form a pair of sidewalls 12 each extending longitudinally. A front of the base board 11 protrudes upward to form a preventing wall 13 extending transversely to be perpendicularly connected with the two sidewalls 12. A rear end of a top of the preventing wall 13 extends rearward to form a connecting board 14 suspended over the base board 11 and extending transversely to be perpendicularly connected with the two sidewalls 12. A receiving recess 15 is defined by the base board 11, the preventing wall 13, the connecting board 14 and the two sidewalls 12 to receive an FPC board 5 therein shown in FIGS. 9-10. The base board 11 defines a plurality of first terminal passageways 16 and second terminal passageways 17 alternately arranged at regular intervals along a transverse direction thereof and communicating with the receiving recess 15. Each of the terminal passageways 16, 17 extends longitudinally to pass through the preventing wall 13. The preventing wall 13 defines a plurality of connecting slots 18 each longitudinally penetrating therethrough to communicate with the receiving recess 15 and connect the first/second terminal passageway 16/17. A top of a rear of the sidewall 12 defines a fastening gap 19 transversely passing therethrough. An outer surface 101 of the sidewall 12 defines a rectangular holding channel 102 extending vertically to connect with the fastening gap 19. A middle of an inner wall of the holding channel 102 protrudes outward to form a semi-columned projection 103 extending longitudinally to divide the holding channel 102 into a first positioning groove 104 at an upper portion thereof and a second positioning groove 105 at a lower portion thereof. A lump 106 is formed at a junction of the holding channel 102 and the fastening gap 19 and protruded toward the same direction as the projection 103. The lump 106 extends longitudinally and is of semi-columned shape.

Figure 4:
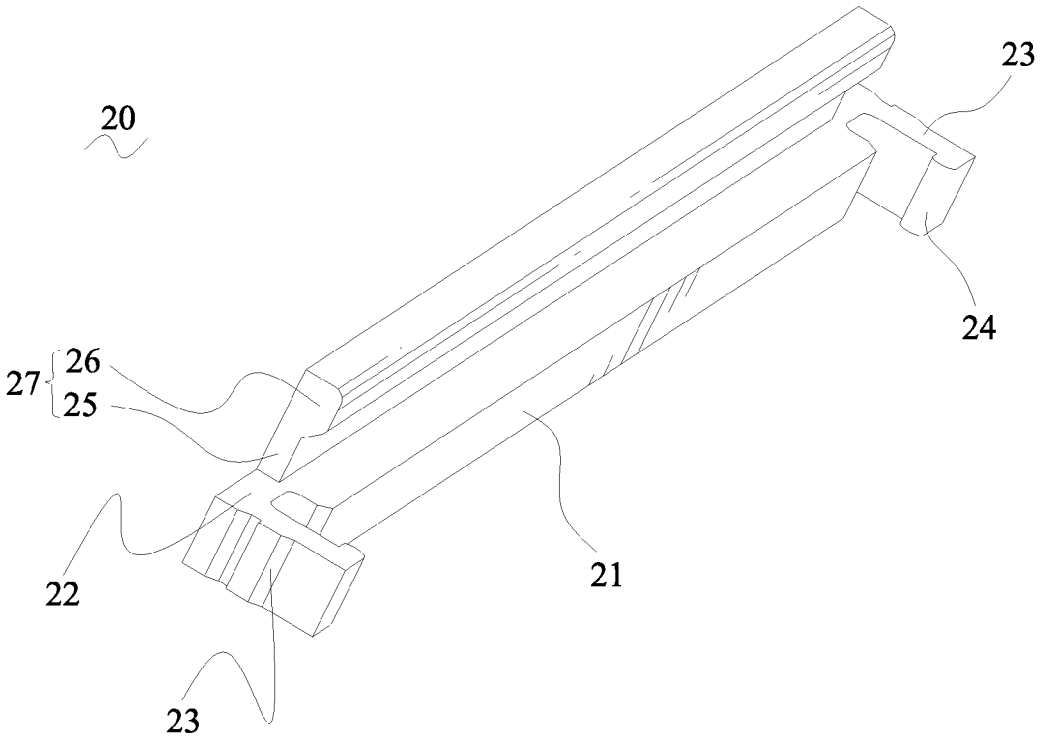
FIG. 4 is a perspective view of a pressing cover of the FPC connector of FIG. 1.

Referring to FIG. 2 and FIG. 4, the pressing cover 20 has a base portion 21 of rectangular-bar shape extending transversely. Bottoms of two opposite ends of the base portion 21 are recessed upward to form a pair of fastening portions 22. Two free ends of the fastening portions 22 extend downward to form a pair of connecting arms 23 spaced from the base portion 21. Bottom ends of the connecting arms 23 are protruded face-to-face to form a pair of buckling portions 24 with a trapeziform shape. The top of the base portion 21 extends forward to form a holding board 25 extending transversely. A front of the holding board 25 extends downward to form a pressing rib 26 extending transversely. The holding board 25 and the pressing rib 26 are composed of a pressing portion 27.

Figure 5:
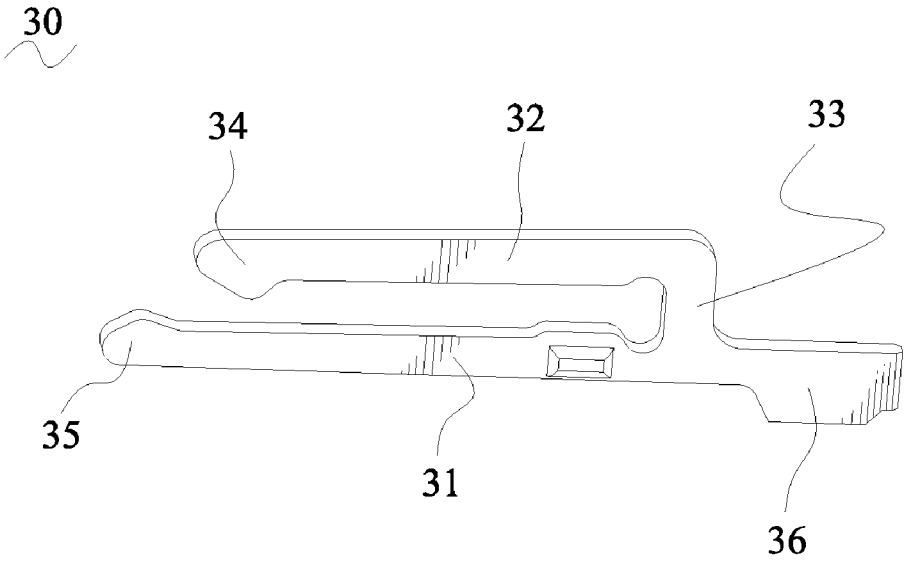
FIG. 5 is a perspective view of a first electric terminal of the FPC connector of FIG. 1.

Referring to FIG. 2 and FIG. 5, each of the first electric terminals 30 has a substantially lying-U shaped base frame which has a lower arm defined as a first bearing arm 31 and an upper arm defined as a first elastic arm 32 slightly shorter than the first bearing arm 31. A first connecting arm 33 is formed to perpendicularly connect two ends of the first bearing arm 31 and the first elastic arm 32. A free end of the first elastic arm 32 protrudes downward to form a first contact portion 34 and a free end of the first bearing arm 31 protrudes upward to form an interference portion 35. The first bearing arm 31 further extends toward an opposite direction to the base frame and then is protruded downward to form a first soldering portion 36.

Figure 6:
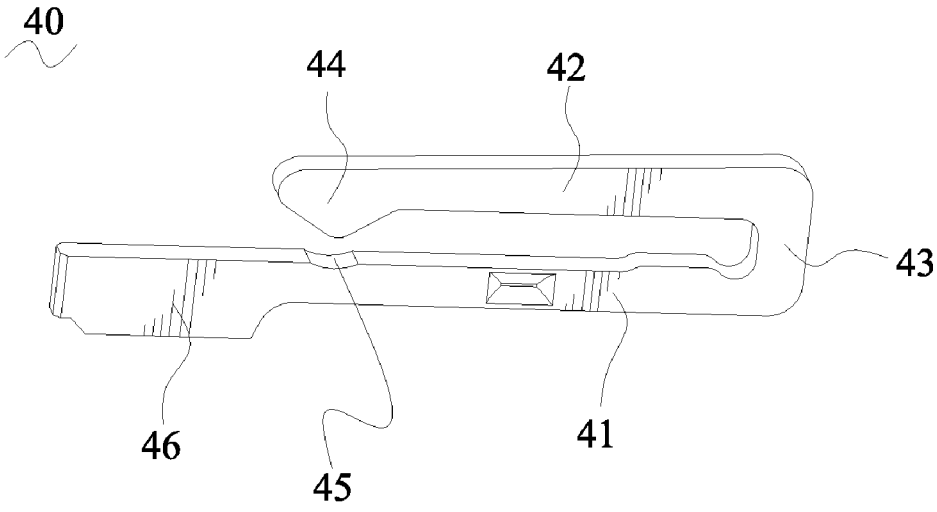
FIG. 6 is a perspective view of a second electric terminal of the FPC connector of FIG. 1.
Figure 7:
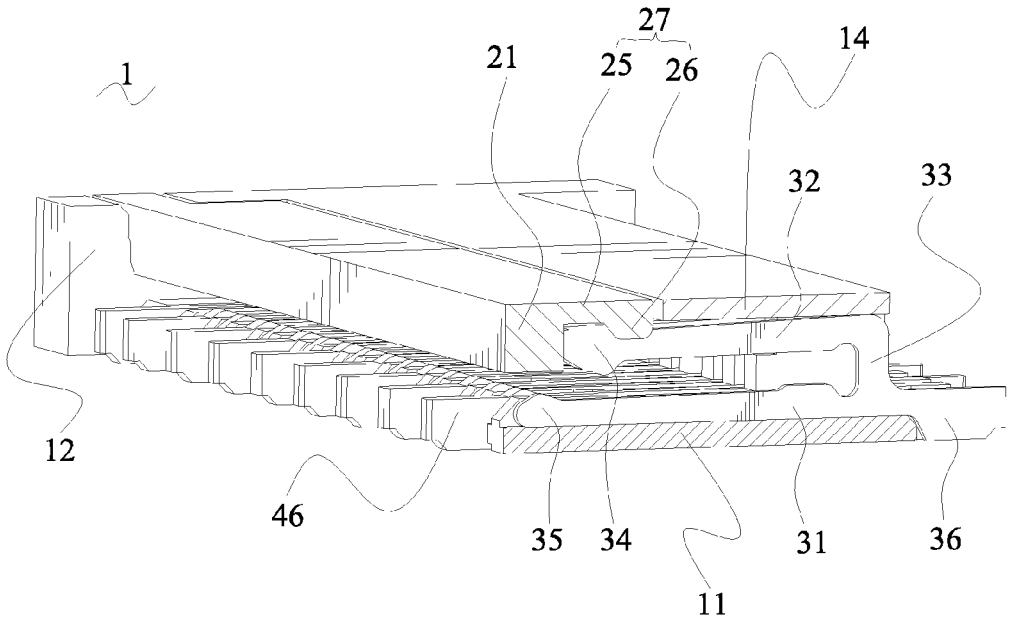
FIG. 7 is a sectional view of the FPC connector of FIG. 1 showing the first electric terminal disposed in the insulating housing, when the pressing cover is closed.

Referring to FIG. 2 and FIG. 6, each of the second electric terminals 40 has a substantially lying-U shaped base frame which has a lower arm defined as a second bearing arm 41 and an upper arm defined as a second elastic arm 42 shorter than the second bearing arm 41. A second connecting arm 43 is formed to perpendicularly connect two ends of the second bearing arm 41 and the second elastic arm 42. A free end of the second elastic arm 42 protrudes towards the second bearing arm 41 to form a second contact portion 44. A portion of the second bearing arm 41 defines a notch 45 facing the second contact portion 44 and a free end of the second bearing arm 41 is protruded towards an opposite direction to the second elastic arm 42 to form a second soldering portion 46.

Referring to FIGS. 2-10, in assembly, the first electric terminals 30 are inserted rearward with the first connecting arms 33 being inserted into the corresponding connecting slots 18 of the insulating housing 10, the first bearing arms 31 being fastened in the corresponding first terminal passageways 16, and the first elastic arms 32 abutting against a bottom surface of the connecting board 14 and further stretching beyond a rear edge of the connecting board 14. The first soldering portions 36 are exposed out of a front of the corresponding first terminal passageways 16 for being soldered with a printed circuit board (not shown). The second electric terminals 40 are inserted forward with the second connecting arms 43 being inserted into the corresponding connecting slots 18 of the insulating housing 10, the second bearing arms 41 being fastened in the corresponding second terminal passageways 17, and the second elastic arms 42 abutting against the bottom surface of the connecting board 14 and further stretching beyond the rear edge of the connecting board 14. The second soldering portions 46 are exposed out of a rear of the corresponding second terminal passageways 17 for being soldered with the printed circuit board. The first soldering portions 36 and the second soldering portions 46 are set at two opposite sides of the insulating housing 10 and alternately arranged so as to strengthen the soldering between the FPC connector 1 and the printed circuit board. The pressing cover 20 is mounted to a rear of the insulating housing 10 behind the connecting board 14 with the base portion 21 being located behind the contact portions 34, 44, the holding board 25 of the pressing portion 27 being located over the elastic arms 32, 42 to make the pressing rib 26 of the pressing portion 27 traversed against the elastic arms 32, 42, the buckling portions 24 being buckled into the corresponding first positioning grooves 104 from the corresponding lumps 106, and the fastening portions 22 being suspended over the corresponding fastening gaps 19.

When the FPC connector 1 is in use, the FPC board 5 is inserted forward into the receiving recess 15 of the insulating housing 10 and located between the bearing arms 31, 41 and the elastic arms 32, 42 of the electric terminals 30, 40 so as to electrically contact the contact portions 34, 44. Then the pressing cover 20 is pushed downward to make the pressing rib 26 of the pressing portion 27 press the elastic arms 32, 42 downward so as to make the FPC board 5 clipped firmly by means of the contact portions 34, 44 and the interference portions 35 and ensure a steady electrical connection between the FPC board 5 and the electric terminals 30, 40. Furthermore, the base portion 21 of the pressing cover 20 abuts against a top surface of the FPC board 5 so that further secures the FPC board 5 in the FPC connector 1. At this time, the buckling portions 24 are slid into the corresponding second positioning grooves 105 from the corresponding projections 103, the fastening portions 22 are fastened into the corresponding fastening gaps 19 and the connecting arms 23 are held in the corresponding holding channels 102 for ensuring a firm engagement between the insulating housing 10 and the pressing cover 20.

When the FPC board 5 is to be withdrawn from the FPC connector 1, the pressing cover 20 is pulled upward to make the buckling portions 24 re-slid into the corresponding first positioning grooves 104 from the corresponding projections 103. At this moment, the pressing rib 26 of the pressing cover 20 releases the pressure to the elastic arms 32, 42 of the electric terminals 30, 40, and the base portion 21 of the pressing cover 20 is away from the top surface of the FPC board 5 so that facilitates the FPC board 5 to be drawn out from the receiving recess 15.

As described above, the pressing cover 20 of the FPC connector 1 is vertically mounted onto the insulating housing 10 so that the pressing cover 20 can contact the FPC board 5 at the same time for avoiding the FPC board 5 moving along the insertion and withdrawal direction thereof during the pressing cover 20 is closed and further ensuring a stable electrical connection between the electric terminals 30, 40 and the FPC board 5.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A connector adapted for receiving a longitudinally inserted flexible printed circuit board therein, comprising:

an insulating housing having a base board disposed levelly, two opposite ends of the base board protruding upward to form a pair of sidewalls extending longitudinally with a receiving recess formed therebetween for receiving the flexible printed circuit board;

a plurality of electric terminals disposed in the insulating housing in a transverse row, each of the electric terminals having an elastic arm stretched into the receiving recess and suspended over the base board, the flexible printed circuit board being longitudinally inserted between the base board and the elastic arms for electrically connecting the electric terminals; and a pressing cover vertically movably mounted onto the insulating housing and having a base portion extending transversely to be spanned onto the two sidewalls, a portion of the base portion extending forward to form a pressing portion transversely spanned over the elastic arms of the electric terminals for pressing the elastic arms downward against the flexible printed circuit board when the pressing cover is pressed downward to be closed so as to make the flexible printed circuit board tightly clipped between the elastic arms and the base board.

2. The connector as claimed in claim 1, wherein the pressing portion has a holding board is extended from the base portion, a front portion of the holding board protrudes downward to form a pressing rib extending transversely for pressing the elastic arms against the flexible printed circuit board.

3. The connector as claimed in claim 1, wherein the pressing portion is extended from a top of the base portion, the base portion is located behind free ends of the elastic arms to abut against the flexible printed circuit board when the pressing cover is pressed downward to be closed.

4. The connector as claimed in claim 1, wherein a rear of an outer surface of the sidewall defines a first positioning groove and a second positioning groove below the first positioning groove, a projection is formed between the first positioning groove and the second positioning groove, a pair of connecting arms is extended downward from two opposite ends of the base portion, bottom ends of the connecting arms are protruded face-to-face to form a pair of buckling portions, the buckling portions are slid into and positioned in the corresponding second positioning grooves from the first positioning grooves by way of the projections to make the pressing cover engaged with the insulating housing tightly when the pressing cover is pressed downward to be closed.

5. The connector as claimed in claim 4, wherein bottoms of the two opposite ends of the base portion are recessed upward to form a pair of fastening portions, the connecting arm is formed by extending downward from a free end of the corresponding fastening portion and spaced from the base portion, a top of the sidewall defines a fastening gap substantially aligned with the positioning grooves for fastening the corresponding fastening portion therein.

6. The connector as claimed in claim 1, wherein a front of the base board protrudes upward to form a preventing wall extending transversely to be perpendicularly connected with the two sidewalls for preventing the flexible printed circuit board inserted overly.

7. The connector as claimed in claim 6, wherein a top portion of the preventing wall extends rearward to form a connecting board suspended over the base board and extending transversely, the elastic arms are located under the connecting board and further stretch beyond a rear edge of the connecting board, the pressing cover is mounted behind the connecting board.

8. The connector as claimed in claim 1, wherein each of the electric terminals has a lying-U shaped base frame which has a lower arm defined as a bearing arm and an upper arm defined as the elastic arm, the bearing arm is disposed in the base board, the flexible printed circuit board is further inserted between the bearing arms and the elastic arms.

9. The connector as claimed in claim 8, wherein a free end of the elastic arm protrudes downward to form a contact portion electrically contacting the flexible printed circuit board, a plurality of interference portions and notches are alternately formed on the bearing arms against the flexible printed circuit board.

10. The connector as claimed in claim 8, wherein the electric terminals disposed in the insulating housing in the transverse row have respective soldering portions alternately formed at front ends and rear ends of the bearing arms for respectively being exposed from a front and a rear of the base board of the insulating housing to ensure a stable soldering.

* * * * *